US005291168A

United States Patent [19]

Woods et al.

[11] Patent Number: 5,291,168

[45] Date of Patent: Mar. 1, 1994

[54] CONNECTOR COOLING AND PROTECTION FOR POWER COUPLING ASSEMBLY FOR SUPERCONDUCTING MAGNETS

[75] Inventors: Daniel C. Woods; William S. Stogner; David R. Turner, all of Florence, S.C.

[73] Assignee: General Electric Company, Milwaukee, Wis.

[21] Appl. No.: 880,847

[22] Filed: May 11, 1992

[51] Int. Cl.[5] ..... H01F 1/00

[52] U.S. Cl. ..... 335/216; 174/15.4; 174/17 VA

[58] Field of Search ..... 335/216; 503/1; 174/17.4, 17.07, 17 VA

[56] References Cited

U.S. PATENT DOCUMENTS 3,839,698 10/1974 Bitcliffe et al. ..... 335/216

5,099,215 3/1992 Woods et al. ..... 335/216

*Primary Examiner*—Lincoln Donovan

*Attorney, Agent, or Firm*—Irving Freedman; James O. Skarsten

[57] ABSTRACT

Power couplings are provided from outside the shell of a superconducting magnet through the intervening space and through the cryogen pressure vessel to the magnet coils within the vessel. The multi-pin shim magnet connector is replaceable without cutting the vessel open and the shim and main magnet main coil connectors include central apertures through which cryogen boil-off gas is flowed before venting to cool the connectors and reduce boil-off.

18 Claims, 4 Drawing Sheets

CONNECTOR COOLING AND PROTECTION FOR POWER COUPLING ASSEMBLY FOR SUPERCONDUCTING MAGNETS

BACKGROUND OF THE INVENTION

This invention relates to improved power connectors for superconducting magnets which connect external power through the pressurized magnet vessel to the coils inside the vessel.

As is well known, a magnet can be made superconductive by placing it in an extremely cold environment, such as by enclosing it in a cryostat or pressure vessel containing liquid helium or other cryogen which slowly boils off, forming a cryogen gas which is vented out of the cryostat. The extreme cold reduces the resistance in the magnet coils to negligible levels, such that when a power source is initially connected to the coil (for a period, for example, of only ten minutes) to introduce a current flow through the coils, the current will continue to flow through the coils due to the negligible resistance at superconducting temperature even after power is removed, thereby maintaining a magnetic field. Superconducting magnets find wide application, for example, in the field of magnetic resonance imaging (hereinafter "MRI").

In a typical superconducting magnet, the cryostat or pressurized helium vessel is positioned within, but spaced from, a vacuum vessel with a significant temperature gradient therebetween. As a result, the shim lead connector assembly and power leads must extend through a wide temperature range from the outside of the vacuum vessel to the interior of the pressurized vessel.

A multi-pin cryostat connector typically extends through the wall of the cryostat for coupling to the plurality of shim or adjusting magnets, commonly with male pins on the exterior and extending away from the cryostat, to enable coupling through a mating female connector. The cryostat connector can be damaged by multiple insertion and retraction operations of the shim lead coupling assembly, particularly since the connectors must be mated by manipulation of the shim lead connector assembly from a distance, typically well in excess of one foot, from the outside of the vacuum vessel.

A power coupling assembly for which the present invention is applicable is disclosed in co-pending U.S. patent application, Ser. No. 07/880,848 filed May 11, 1992 by William S. Stogner and Daniel C. Woods, assigned to the same assignee as the present invention, and hereby incorporated by reference. In such an arrangement, if the connector pins of the cryostat connector are damaged, it is a difficult and costly procedure to replace the cryostat connector since it passes through the pressurized vessel and vacuum vessel. As a result, the pressurized vessel and the vacuum vessel must be cut open, the cryostat connector replaced, and the pressurized vessel and vacuum vessel subsequently reassembled and vacuum space evacuated.

Similarly, a main coil power connection is provided through the pressurized vessel to carry the heavy currents used to energize the main coils. The current to the main magnet coils is far larger than that to the shim magnet coils, such that it is also important to minimize the resistance heating due to that current flow.

However, any solution to these problems must avoid increasing the resistance heating resulting from current flow through the connector assembly, since even a single watt of heating can result in the boiling of 1.4 liters per hour of helium, which is completely unacceptable, since a typical MRI specification limits the helium boil-off to only 0.2 liters per hour. Accordingly, it is important to reduce and minimize the resistance heating resulting from current flow through the MRI power connectors to the superconducting magnets. Also, any solution must insure positive electrical contact, and be practical and useful in the presence of conflicting thermal, electrical and mechanical considerations.

OBJECTS AND SUMMARY OF THE INVENTION

Accordingly, a primary object of the present invention is to reduce the heat generated by the power connectors to the magnet coils within the cryostat in a superconducting magnet.

A further object of the present invention is to provide a new and improved replaceable multi-pin shim coil connector for the shim lead coupling assembly for a superconducting magnet.

Another object of the present invention is to provide improved connectors for the pressurized magnet vessel of a superconducting magnet which do not increase the electrical resistance or heating in applying power to the superconducting magnets.

Still another object of the present invention is to provide an improved replaceable multi-pin connector for the shim lead coupling assembly of a superconducting magnet which may be firmly secured in place, yet may be removed from outside the vacuum vessel which surrounds, but is spaced from, the pressurized vessel.

In order to attain the above and other related objectives, in carrying out the present invention in one form thereof, connector assemblies provide power from outside the vacuum vessel surrounding, and spaced from, the cryogen pressure vessel to the magnets within the pressure vessel. Apertures are provided through the connectors for the shim magnets and main magnets, and cryogen gas boil-off flow cools the leads and connectors before the gas is vented, reducing the amount of cryogen boil-off. A detachable replaceable adapter connector is interposed between the magnet shim coil connector assembly and the shim lead coupling assembly connector which passes through the walls of the pressure vessel, and suitable tools are provided to secure and detach the adapter connector.

Figure 1:
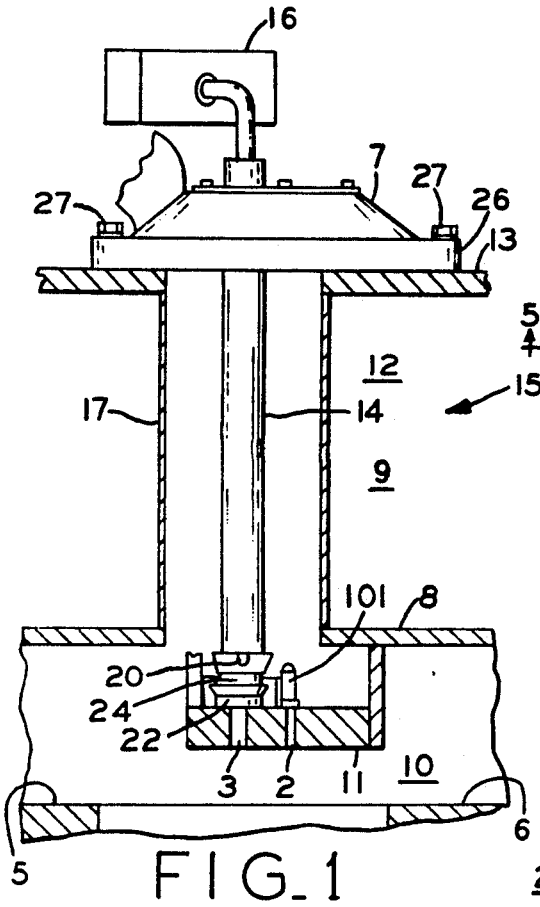
FIG. 1 shows a superconducting magnet assembly utilizing the present invention, shown partially in cross section.
Figure 2:
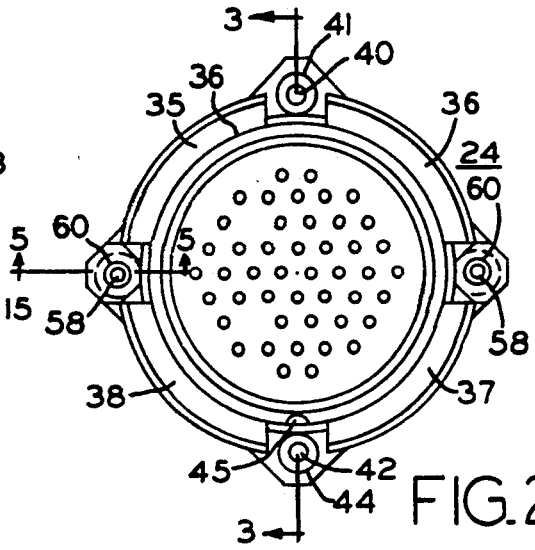
FIG. 2 is an enlarged top view of the replaceable connector protector shown in FIG. 1.

Referring first to FIG. i. Superconducting magnet assembly 9 includes a pressure vessel or cryostat 10 containing liquid helium positioned within a vacuum vessel 12, a portion of which is indicated by the outer walls 13. A tubular shim lead assembly 14 extends through well or tubular housing 17 from outside the outer shell or vacuum vessel 12 to contact the connector 22 on magnet power connector platform 11, which passes through walls 8 of pressurized vessel 10. Shim lead assembly 14 is connected on the outside of walls 13 of vacuum vessel 12 through a fastening plate 26 bolted to the walls by bolts 27, through the service turret 7 to the external connector enclosure 16, to which external power is applied in order to apply power through connector 22 to the shim or adjusting magnet coils (not shown) within the pressurized vessel 10.

The distance between walls 13 of vacuum vessel 12 and walls 8 of helium pressure vessel 10 is well in excess of one foot in a typical cryostat, such that the temperature gradient along shim lead assembly 14 extends all the way from the ambient temperature outside vacuum vessel 12 to the cryogenic temperature (in the order of −270° C.) at the bottom of the assembly.

It is to be noted that coupling or mating of connector 20 at the bottom of shim lead assembly 14 to the cryostat connector 22 must be accomplished from outside vacuum vessel 12, without a clear view of connector 22. As a result, it is possible, particularly in the event of multiple insertion and retraction operations of lead assembly 14, that the multiple relatively slender connector pins in the cryostat connector 22 can be damaged, resulting in the necessity of depressurizing the pressurized vessel 10, cutting open the walls 8 and 13 of helium vessel 10 and vacuum vessel 12, respectively, and replacing cryostat connector 22.

The main coils 5 and 6 of the superconducting magnet assembly receive external power through a pair of main coil lead pins 101, to which power is detachably applied as explained in detail below.

In accordance with one aspect of the present invention, a protector connector 24 is interposed between cryostat connector 22 and connector 20 at the bottom of the shim lead assembly 14.

Connector protector 24 is best shown in FIGS. 2–5.

Referring to FIGS. 2–5, connector protector 24 includes a unitary housing 30 provided with upper flared extensions 35, 36, 37, and 38, forming a generally funnel-shaped opening 34. Supported within housing 3 is a plurality of connections which are formed into pins 31 at the upper end, and sockets 33 at the bottom, with the same standard industry pin configuration utilized in cryostat connector 22. This enables connector protector 24 to be interposed between the cryostat connector 22 and connector 20 at the bottom of power lead assembly 14, with female connector sockets 33 mating with the male pins in the cryostat connector, and pins 31 mating with the connector sockets in connector 20. The funnel-shaped opening 34 guides and facilitates the proper insertion of connector 20 into protector connector 24. Orientation or positioning key such as 45 in housing 24 (see FIG. 2) in cryostat connector 22 cooperates with a similarly shaped mating orientation or positioning keyway 28 (see FIG. 4) in the bottom of the housing to assist in the proper orientation of, and connection of, connector protector 24 and cryostat connector 22.

A pair of captive retaining screws 60 (see FIGS. 2 and 5) on diametrically opposed portions of housing 30 pass freely through apertures 58 to extend below the bottom of the housing adjacent connector sockets 33. Captive retaining screws 60 include a head 67 with a hexagonal bore 68, and a capture ring or retainer 62 threaded at the bottom region of the retaining screw. It is to be noted that the upper aperture or bore 61 is of a lesser diameter or cross section than the lower aperture or chamber 63, providing a shoulder 65 at their intersection. As a result, retainer 62 of retaining screw 60 is freely moveable in the axial direction within chamber 63 but is prevented by shoulder 65 from being removed completely without unthreading the retainer. Also, threaded lower end 56 of captive retaining screw 60 is retractable within chamber 63 to enable the retaining screw to be moved out of the way in the vertical plane during the electrical connection of connector protector 24 to cryostat connector 22.

Thus, when connector protector 24 is being positioned into mating contact with cryostat connector 22, retaining screws 60 are freely moveable to a retracted position within chamber 63 to prevent interference by the retaining screws during the positioning and electrical connection. However, after the connection, captive retaining screws 60 can be moved downward out of chamber 63 into mating threaded apertures (not shown) in the magnet connector platform 11 to secure the connector protector firmly in place. Magnet connector platform 11 forms a portion of walls 8 of pressure vessel 10.

Figure 7:
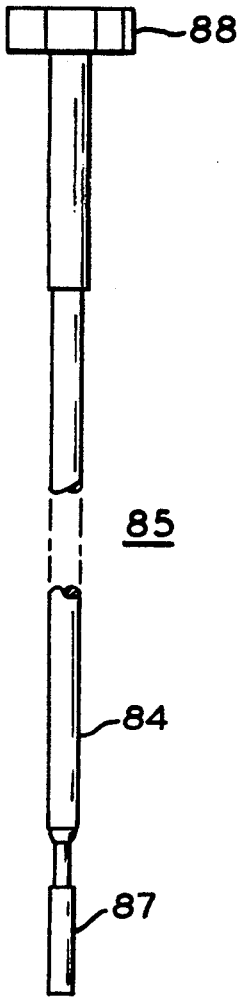
FIG. 7 shows a screw insertion tool useful in connection with the present invention.
Figure 8:
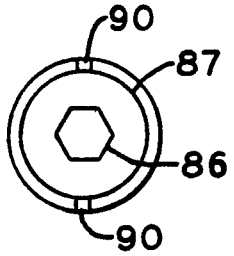
FIG. 8 is an enlarged bottom view of FIG. 7.

Rotation of captive retaining screws 60 is accomplished from outside vacuum vessel 12 through use of screw insertion (and retraction) tool 85 shown in FIG. 7. Referring to FIG. 7, screw insertion tool 85 includes a central rod 84 with a knurled or hex head handle 88 at one end, and a cylindrical guide 87 at the opposite end. As best shown in FIG. 8, centrally positioned within cylindrical guide 87 is hex key 86 with a hexagonal cross section dimensioned to fit the hexagonal bore 68 of captive retaining screws 60. Cylindrical guide 87 also includes a pair of diametrically opposed slots 90 extending axially a distance of about twice the height, or axial length, of head 67 of captive retaining screws 60, providing a small degree of resiliency to the cylindrical guide.

Protector connector 24 may be positioned on cryostat connector 22 before assembly of vacuum vessel 12 around pressure vessel 10 or after the assembly. Once protector connector 24 and vacuum vessel 12 are in position, tubular shim lead assembly 14 may be inserted through service turret 7, and through space 15, to the pressurized vessel 10, oriented and pressed into contact with protector connector 24, as best shown in FIG. 1.

Funnel-shaped extension 34 and orientation key 45 assist and facilitate the proper positioning and insertion of lead assembly 14 into protector connector 24. In the event that connector pins 31 of protector connector 24 should become damaged during repeated insertions or retractions of shim lead assembly 14, it is possible to replace the protector connector with a substitute protector connector. Removal of the protector connector 24 can be accomplished through use of the screw insertion tool 85 described above and the protector connector tool 76 (shown in FIGS. 6, 9 and 10).

Figure 6:
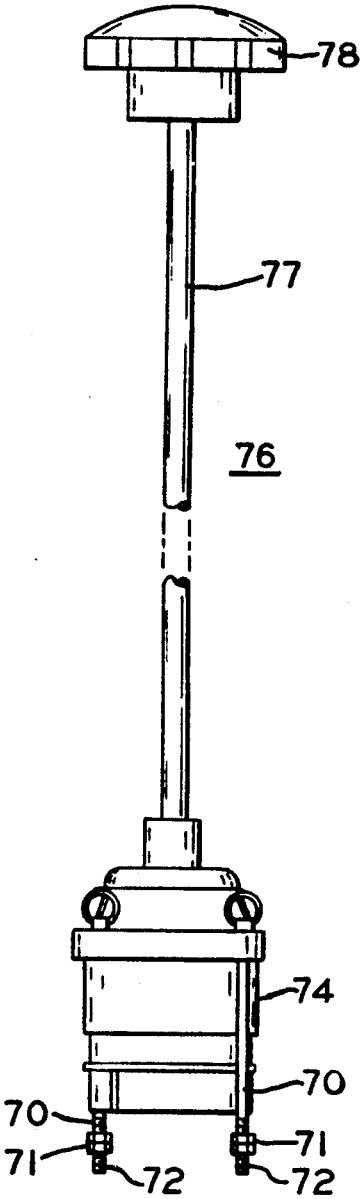
FIG. 6 shows a connector protector insertion tool useful in connection with the present invention.

As shown in FIG. 6, connector protector insertion (and retraction) tool 76 includes a central extension rod 77 with knurled handle 78 at one end and connector housing 74 at the opposite or remote end. Connector housing 74 includes a female connector configured to mate with connector pins 31 of connector protector 24 (and cryostat connector 22). Connector protector tool 76 includes a pair of captive retaining screws 70 with retainers 71 positioned to maintain exposed threads 72 below the retainers. Connector protector 24 includes a pair of diametrically opposed threaded apertures 40 (see FIG. 2) with a countersunk bore having a conical or funnel-shaped opening at the top, below which is a threaded aperture 42. The spacing and threads of retaining screws 70 of connector protector tool 76 are configured to contact and screw into threaded apertures 40 of connector protector 24 in order to provide connector protector tool 76 with a means to clamp to connector protector 24 for purposes of inserting (or removing) the connector protector through space 15 and service turret 7 (see FIG. 1).

Figure 9:
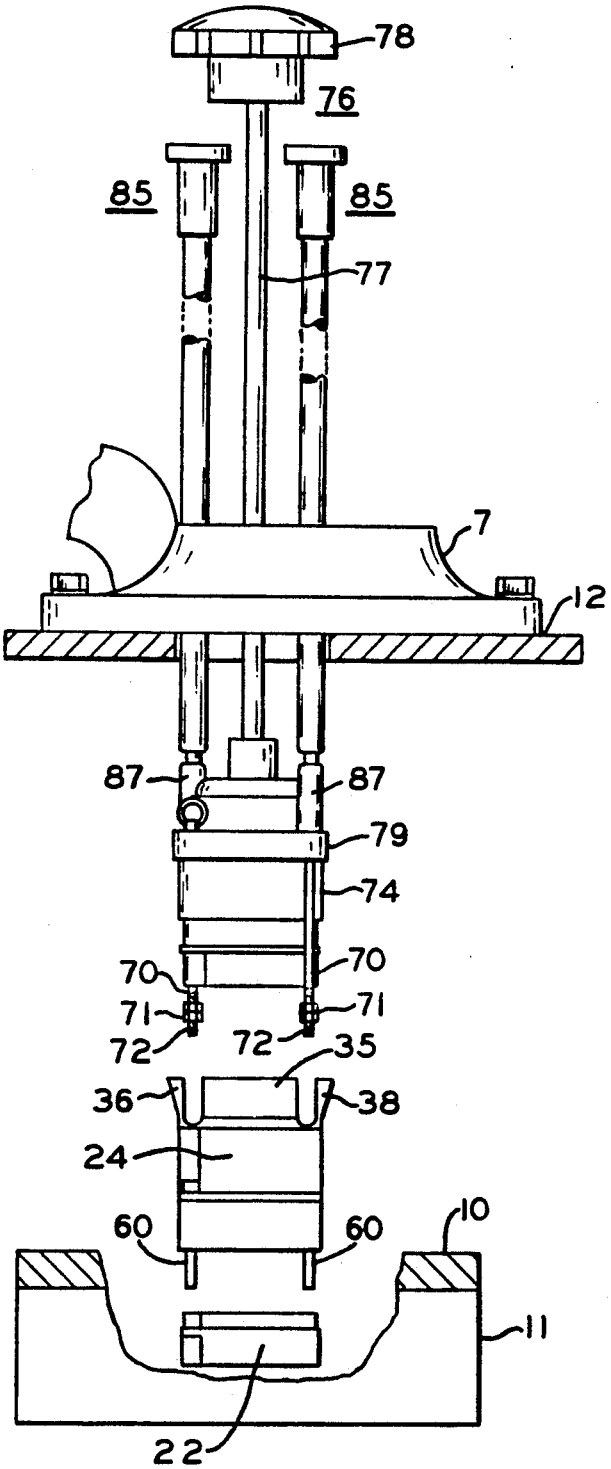
FIG. 9 shows the use of the tools shown in FIGS. 6–8 in inserting or removing a connector protector shown in FIGS. 2–5.

As illustrated in FIG. 9, connector protector 24 may be readily detached and removed from cryostat connector 20. Retaining screws 60 are unfastened first using screw insertion and retraction tool 85 by reversing the procedure described above. Then connector protector tool 76 is attached to connector protector 24. Screw insertion and retraction tools 85 are shorter in length than the connector protector tool. Retaining screws 70 of tool 76 are screwed into threaded apertures 40 of connector protector 24 by screw tool 85, fastening connector protector tool 76 to the connector protector. Connector protector 24 may then be withdrawn by withdrawing connector protector tool 76 up through service turret 7.

Figure 10:
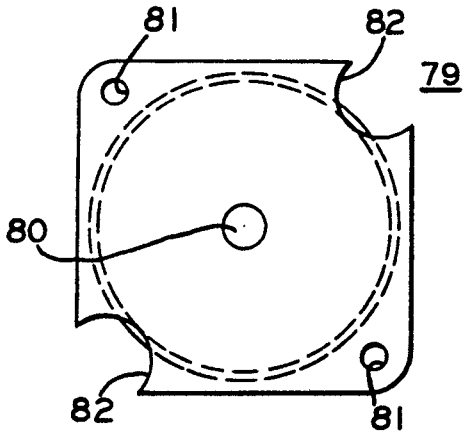
FIG. 10 is an enlarged top view of a portion of the connector protector insertion tool shown in FIGS. 6 and 9.

It is to be noted that captive screw 60 on the connector protector 24, and captive retaining screw 70 on the connector protector tool 76, have the same size head and hexagonal apertures (such as 67 and 68, respectively) so that screw insertion or retraction tool 85 will fit both sets of screws. Also, as best shown in FIG. 10, integral end plate 79 of connector housing 74 of connector protector tool 76 includes arcuate access holes or cutouts 82 at opposite corners to enable the passage of screw insertion tools 85 to contact retaining screws 60 in connector protector 24. Also as shown in FIG. 10, integral end plate 79 includes a centrally located threaded aperture 80 into which extension rod 77 is screwed, and a pair of diametrically opposed apertures 81 intermediate the arcuate access holes 82 through which the captive retaining screws 70 pass. Apertures or bores 81 allow the retaining screws 70 to pass freely through; however, retraction of the screws into housing 74 is prevented because retainers 71 are of a larger diameter than apertures 81. As a result, threaded ends 72 do not retract.

Figure 3:
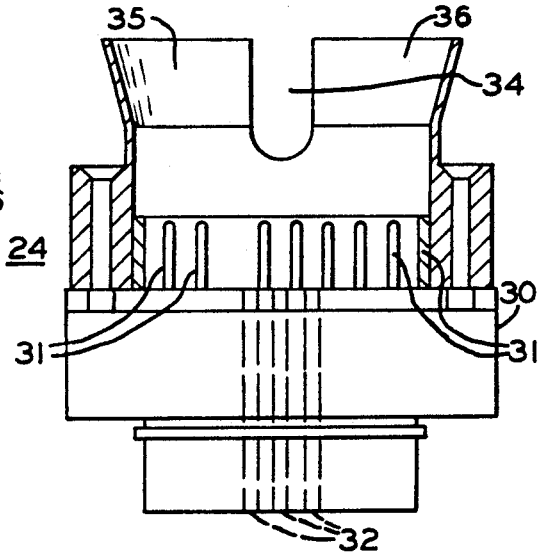
FIG. 3 is a front view, partially in cross section, taken along the lines 3—3 in FIG. 2.
Figure 5:
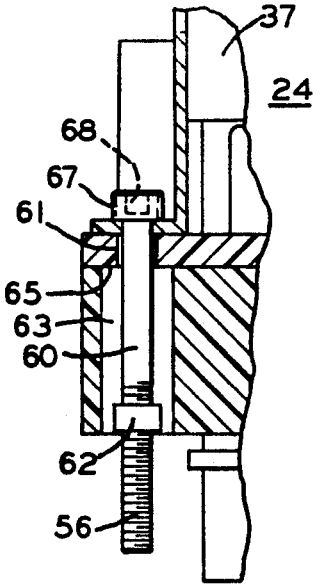
FIG. 5 is an enlarged cross section of a portion of FIG. 2, taken along the lines 5—5 in FIG. 2.
Figure 4:
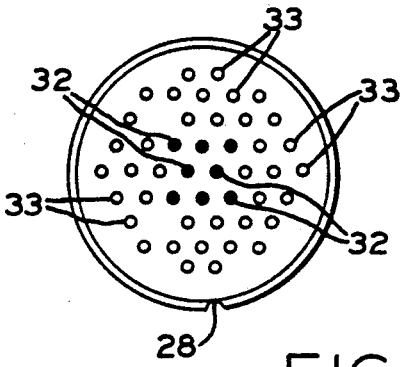
FIG. 4 is a bottom view of a portion of FIG. 3.

Since the connector protector 24 inserts connector pins 31 and connector sockets 33 in series with, and intermediate, connectors 20 and 22, consideration must be directed at increased electrical resistance which may result from the increase in the number of intermediate electrical connections. Increased resistance leads to increased heating, and increased heating can lead to increased helium boil-off. A single watt of heating can result in the boiling of 1.4 liters per hour of helium, which is completely unacceptable, since a typical MRI specification limits the helium boil-off to 0.2 liters per hour, in order to limit the consumption of helium and cost. In order to minimize heating and prevent added heating by connector protector 24, normal helium boil-off which results from the cooling action within cryostat 10, rather than merely being vented outside cryostat 10, is directed to flow through the central region of connector protector 24 before venting. This is accomplished, as best shown in FIGS. 1, 3 and 4, by removing a plurality of unneeded connectors 32, providing multiple passageways through the central region of the connector protector. Corresponding and mating pins on cryostat connector 22 and bottom connector 20 are also removed, enabling the flow of the boiling cryogen from inside pressurized vessel 10 through aperture 3 in magnet connector platform 11 and through the three connectors to the inside of tubular shim lead assembly 14.

It is to be noted that connectors 20, 22 and 24 are all industry standard configuration connectors selected such that there are extra connectors which can be removed to allow the provision of the holes through which to flow the cryogen gas. The connectors may typically utilize as many as thirty-six through or used connections, such that a forty-four pin standard industry connector will allow use of the space of eight unused connections to provide apertures for the passage of cryogenic boil-off gas.

Referring next to FIGS. 11–14, main coil lead pin 101 screws directly into threaded aperture 108 of main coil lead pin bus bar 106 located Within cryostat 10. The threaded base, or inner end, 122 of main coil lead pin 101 is rotatably threaded into the threaded aperture 108 through use of a suitable tool or wrench spanning flatted portions 124 and 126 of shoulder 120 of the main coil lead pin. Cylindrical extension 116 extends above magnet connector platform 11 (see FIG. 1 outside pressure vessel 10 to provide access for external connection of power to the main magnets. Main coil lead pin 101 includes a tapered end 118 to facilitate the positioning and insertion of power lead connector assembly 104 around cylindrical extension 116. Main coil lead pin 101 is silver-plated burnished copper.

Power lead connector 104 includes an axial extension 102 surrounded by an insulating cylindrical member 104 which extends from outside shell 12 through an aperture 129 in outer walls 13 to main coil lead pin 101. External power lead connector 104 also includes a generally bell-shaped housing 130 dimensioned to encircle and make electrical contact with cylindrical extension 116 of main coil lead pin 101.

A circumferential groove or chamber 132 surrounding passageway 112 which extends axially through power lead connector 104 is provided in the region around cylindrical extension 116. Interposed within circumferential chamber 132 is a sleeve or contact band 134 which includes a plurality of axial components or louvers twisted at an angle (as described in detail below regarding FIGS. 14 and 15) to provide electrical contact circumferentially around and between cylindrical extension 116 of main coil lead pin 101 and circumferential groove 132 of power lead connector 104.

Figure 14:
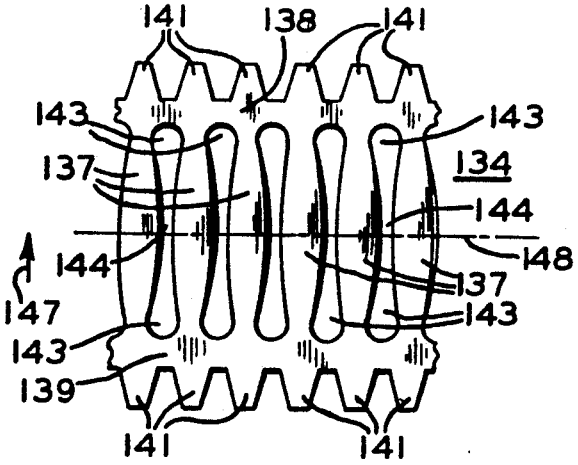
FIG. 14 is an enlarged view of a portion of the contact band shown in FIG. 11.
Figure 15:
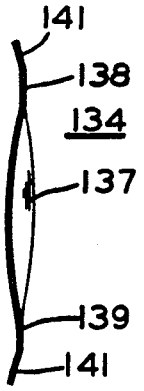
FIG. 15 is a side view of FIG. 14.

Contact band 134 is resilient and of a size which provides an interference and firm fit in order to minimize heating and resultant loss of helium, and is best shown in FIGS. 14 and 15.

Referring to FIGS. 14–15, contact band 134 is fabricated from beryllium copper with extra-heavy silver plating 0.0007 to 0.001 inches thick, and with a band thickness of 0.004 inches. The material is punched into a series of louvers 137 connected at the top and bottom by connecting strips 138 and 139, respectively. The spaces between louvers 137 extend in an axial direction (indicated by arrow 147) with rounded teardrop-shaped tops and bottoms 143 connected by central portions 144. A plurality of tapered outer teeth 141 with flatted ends extend axially from the connecting strips 138 and 139 and generally correspond in width in the circumferential direction (indicated by center line 148), a distance corresponding generally to the width of louvers 137. Louvers 137 are twisted at an angle offset from center line 148 by approximately 15° as shown by arrows 146 in FIG. 15. There are twenty louvers 137 per inch, with a corresponding number of outer teeth 141. The height of the assembly in the axial direction 147 is 0.69 inches and the current carrying capacity of each louver is $15\pm5$ amperes, with a capacity of $300\pm10$ amperes per running inch. The contact band 134 is supplied by Hugin Industries of Los Altos, Calif. under their part number 01292. The 15° angle 146 provides resilient contact between cylindrical extension 116 of main coil lead pin 101 and circumferential groove 132 of power lead connector 104, and the outer teeth 141 provide resilient contact with the circumferential groove 132 of housing 130.

Figure 11:
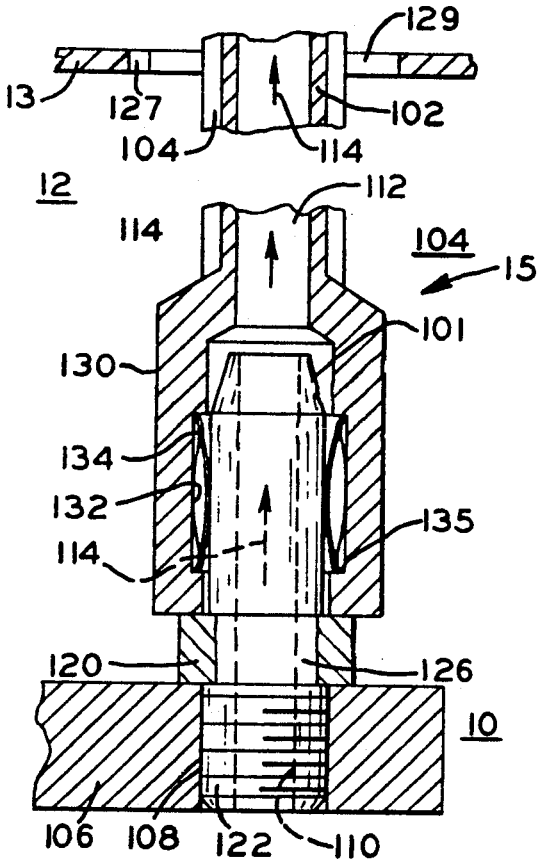
FIG. 11 is an enlarged view showing the main coil lead pin of FIG. 1 with the external power lead connector attached, shown partially in cross section.
Figure 12:
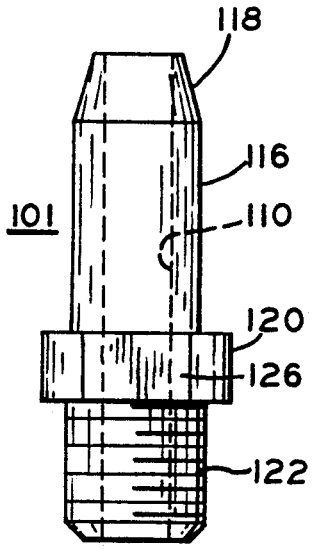
FIG. 12 shows the main coil lead pin of FIG. 11.
Figure 13:
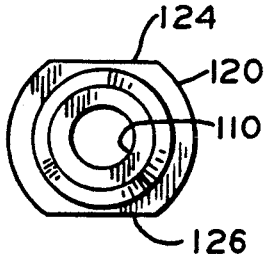
FIG. 13 is a bottom view of FIG. 12.

A cooling flow of helium boil-off gas is provided through the main coil lead pin/power lead connector assembly 101, 104, as best shown in FIGS. 1, 11 and 12. Referring to FIGS. 1, 11 and 12, the direction of cooling gas flow as indicated by arrows 114 is from the interior of helium pressure vessel 10 through aperture 2 in magnet connector platform 11, and then through passageways 110 and 112, which extend axially through main coil lead pin 101 and power lead connector assembly 104. This provides a cooling gas flow to conduct heat away from the main coil lead pin/power connector assembly 101, 104 during the application of electric power through the assembly to main magnet coils 5 and 6 (see FIG. 1). The resistance heating generated during this application of electric power to ramp the superconducting magnets to field (to the superconducting state) can cause a significant increase in cryogen consumption. Also, if the resistance heating at main coil lead pin/power lead connector assembly 101, 104 were relatively high, it could cause the superconducting magnets to quench due to solid conduction of the lead bus-bars or gas conduction in the helium vapor space adjacent to the magnet. The cooling gas vapor flow through the pin and connector assembly reduces the cryogen consumption and helps in avoiding quenching of superconducting magnets 5 and 6 by reducing the heat generated, which can be in the order of as much as 20 watts resulting from a superconducting magnet ramping current of 750 amps. As the helium gas vapor passes through passageway 110 and the interior of main coil lead pin 101, it "warms up," removing a portion of the heat that is generated due to electrical resistance heating at the contact band 134.

It was found that an optimum size of passageway 110 involved considerations of electrical resistance, and mechanical rigidity and strength, of main coil lead pin 101, and the heat transfer coefficient which results from variations in helium gas vapor flow. An optimized cooling efficiency with suitable mechanical and electrical characteristics is realized with a passageway 110 cross section diameter of 0.247–0.255 inches, which generated sufficient velocity and turbulent flow through passageway 110. The diameter of the outside walls of cylindrical extension 116 of main coil lead pin 101 is 0.470–0.472 inches.

Additional cooling, if desired or required, can be provided by channeling a portion of the flow of boil-off cryogen gas outside the main coil lead pin 101 as disclosed in U.S. Pat. No. 5,099,215, of Daniel C. Woods and William S. Stogner, assigned to the same assignee as the present invention, and hereby incorporated by reference.

In order to apply external power through power lead connector assembly 104, the assembly is inserted through aperture 129 and then enters magnet penetration well 17 and continues downward until bell-shaped housing 130 is pressed around cylindrical extension 116 of main coil lead pin 101, with contact band 134 providing an interference fit and good electric contact between the housing and the lead pin. Power can then be applied for a period of approximately 10 minutes to the main magnet coils 5 and 6 from outside magnet penetration well 17 through power lead connector assembly 104, main coil lead pin 101 and bus bar 106 to ramp the main coil magnets to field, after which the power lead connector assembly 104 may be retracted through aperture 129 and the aperture closed by a suitable cover shown, for example, in U.S. patent application Ser. No. 880,848, filed concurrently herewith and assigned to the same assignee as the subject patent application, and hereby incorporated by reference.

After the main coil power lead connector assembly 104 is removed, the helium gas vented through main power lead pin 101 flows through space 15 to be vented through an aperture and venting mechanism, such as 127.

The power connectors of the present invention thus provide power to the magnets of a cryostat with cryogen gas boil-off flowing through the interior of the connectors to decrease heating through the connectors, and provide structure which facilitates insertion, connection and retraction of the connectors.

While the present invention has been described with respect to certain preferred embodiments thereof, it is to be understood that numerous variations in the details of construction, the arrangement and combination of parts, and the type of materials used may be made without departing from the spirit and scope of the invention.

What we claim is:

1. In a superconducting magnet assembly located in a pressurized chamber cryostat containing a liquid cryogen with an outer shell spaced from the pressurized chamber, and in which cryogen boil-off is vented out of the pressurized chamber, a multi-conductor lead assembly extending between the shell and the chamber to connect electrical power to a plurality of electrically separated shim magnet coils positioned within said chamber through a first multi-conductor connector secured to and passing through the wall of the chamber to maintain a gas-tight connection, a conductor assembly extending axially from outside said shell to said first connector for connection to and detachment from said first multi-conductor connector with multiple substantially slender connector pins by manipulation of said conductor assembly from outside said shell without removing said first connector, comprising:

a second multi-conductor connector on the end of said assembly outside said shell adapted for connection to an external power source;

a third multi-conductor adapter connector on the remote end of said assembly configured to mate with said first connector to complete the power circuit from outside said shell to said magnet coils; and a multi-conductor adapter connector configured for attachment and detachment from outside said shell and for protection of said first connector interposed between said first connector and said third connector;

said adapter connector comprising an integral housing having multiple connector pins on one side electrically connected to multiple connector sockets on the opposite side configured to mate with, and interconnect, said first connector and said third connector; and securing means to detachably affix said housing of said adapter connector to said chamber while electrically connected to said first connector and to selectively remain affixed to said first connector upon removal and disconnection of the remainder of said conductor assembly from electrical contact with said first multi-conductor connector;

whereby said tubular conductor assembly may be detachably connected to said adapter connector and said adapter assembly can be secured to said first multi-conductor connector and replaced from outside said shell without removal of said first multi-conductor connector and without opening said pressurized chamber; and the multi-connections of said first connector are not subject to pressures which could damage the multi-connections upon connection and removal of said second multi-conductor connector from said adapter.

2. The superconducting magnet connector assembly of claim 1 wherein said multi-conductor externally removable adapter and protection connector further comprises a generally funnel-shaped extension of said housing of said adapter connector on the side opposite said first connector and an orientation keyway to guide said second multi-conductor connector into mating contact with said adapter connector to facilitate selective electrical connection and detachment of the remainder of said multi-conductor lead assembly to said adapter connector while said adapter connector is affixed to said pressurized chamber and in electrical contact with said first connector.

3. The superconducting magnet connector assembly of claim 2 wherein said securing means includes at least one first threaded member passing freely within at least one aperture in said housing of said adapter connector; and at least one cooperating threaded aperture on said chamber positioned to engage the end of said first threaded member; and said securing means further includes a head portion positioned in the space between said multi-conductor adapter and said shell to be accessible from an opening in said shell for manipulation of said securing means through use of an insertion and retraction tool manipulated from outside said shell through said opening in said shell.

4. In a superconducting magnet assembly located in a pressurized chamber cryostat containing a liquid cryogen with an outer shell spaced from the pressurized chamber, and in which cryogen boil-off is vented out of the pressurized chamber, a lead assembly extending between the shell and the chamber to connect electrical power to magnet coils positioned within said chamber through a first connector passing through the wall of the chamber, a detachable conductor assembly extending axially from outside said shell to said first connector, comprising:

a second connector on the end of said assembly outside said shell adapted for connection to an external power source;

a third connector on the remote end of said assembly configured to mate with said first connector to complete the power circuit from outside said shell to said magnet coils; and an adapter connector interposed between said first connector and said third connector;

said adapter connector comprising an integral housing having connector pins on one side electrically connected to connector sockets on the opposite side configured to mate with, and interconnect, said first connector and said third connector;

securing means to detachably affix said housing to said chamber while electrically connected to said first connector;

whereby said tubular conductor assembly may be detachably connected to said adapter connector;

said adapter connector further comprising a generally funnel-shaped extension of said housing on the side opposite said first connector to guide said second connector into mating contact with said adapter connector;

said securing means including at least one first threaded member passing freely within at least one aperture in said housing;

at least one cooperating threaded aperture on said chamber positioned to engage the end of said first threaded member; a threaded retainer secured to an intermediate section of said first threaded member; said aperture includes a first bore connected to a second bore of a larger diameter forming a shoulder therebetween; and said threaded retainer is dimensioned and positioned to pass freely through said second bore in the axial direction of the bores until contact of said retainer with said shoulder prevents complete axial extraction of said first threaded member, while enabling sufficient axial movement for said retainer and said end of said first threaded member to be positioned within said second bore.

5. In a superconducting magnet assembly located in a pressurized chamber cryostat containing a liquid cryogen with an outer shell spaced from the pressurized chamber, and in which cryogen boil-off is vented out of the pressurized chamber, a lead assembly extending between the shell and the chamber to connect electrical power to magnet coils positioned within said chamber through a first connector passing through the wall of the chamber, a detachable conductor assembly extending axially from outside said shell to said first connector, comprising:

a second connector on the end of said assembly outside said shell adapted for connection to an external power source;

a third connector on the remote end of said assembly configured to mate with said first connector to complete the power circuit from outside said shell to said magnet coils; and an adapter connector interposed between said first connector and said third connector;

said adapter connector comprising an integral housing having connector pins on one side electrically connected to connector sockets on the opposite side configured to mate with, and interconnect, said first connector and said third connector;

securing means to detachably affix said housing to said chamber while electrically connected to said first connector;

whereby said tubular conductor assembly may be detachably connected to said adapter connector;

said adapter connector further comprises a generally funnel-shaped extension of said housing on the side opposite said first connector to guide said second connector into mating contact with said adapter connector;

said securing means includes at least one first threaded member passing freely within at least one aperture in said housing;

at least one cooperating threaded aperture on said chamber positioned to engage the end of said first threaded member; and at least one first threaded member includes a head with a recessed polygonal bore configured to receive a mating polygonal wrench for rotation of said at least one first threaded member to secure said adapter connector in contact with said first connector, and to enable reverse rotation of said at least one first threaded member to detach said adapter connector from contact with said first connector.

6. In a superconducting magnet assembly located in a pressurized chamber cryostat containing a liquid cryogen with an outer shell spaced from the pressurized chamber, and in which cryogen boil-off is vented out of the pressurized chamber, a lead assembly extending between the shell and the chamber to connect electrical power to magnet coils positioned within said chamber through a first connector passing through the wall of the chamber, a detachable conductor assembly extending axially from outside said shell to said first connector, comprising:

a second connector on the end of said assembly outside said shell adapted for connection to an external power source;

a third connector on the remote end of said assembly configured to mate with said first connector to complete the power circuit from outside said shell to said magnet coils; and an adapter connector interposed between said first connector and said third connector;

said adapter connector comprising an integral housing having connector pins on one side electrically connected to connector sockets on the opposite side configured to mate with, and interconnect, said first connector and said third connector;

securing means to detachably affix said housing to said chamber while electrically connected to said first connector;

whereby said tubular conductor assembly may be detachably connected to said adapter connector; and means are provided to remove said adapter connector from outside said shell without removing said first connector;

said means to remove said adapter connector includes a plurality of spaced axially extending threaded apertures in said housing; and a retractor tool; said retractor tool including a handle, a plurality of spaced threaded screws configured to engage the threads in said spaced threaded apertures, and an extension member between said handle and said spaced threaded screws;

said extension member being of adequate length to allow said retractor tool to axially extend from outside said shell to said adapter connector when said adapter connector is secured to said first connector.

7. The superconducting magnet connector assembly of claim 6 wherein said mating polygonal wrench is used in removing said adapter connector, and said wrench is part of a screw manipulator tool which further comprises:

a handle at one end, said polygonal wrench at the remote end, and a spacing rod in between;

said polygonal wrench being configured to mate with said recessed polygonal bore; and rotation of said screw manipulator tool in the direction opposite to that used in securing said adapter connector to said chamber disengages said adapter connector from said chamber.

8. The superconducting magnet connector assembly of claim 7 wherein said screw insertion tool includes a tubular extension surrounding said hexagonal wrench with an inside diameter sufficient to encircle said head of said at least one first threaded member to assist in guiding said hexagonal wrench into said recessed bore.

9. The superconducting magnet connector assembly of claim 8 wherein said retractor tool includes an integral end plate having cutouts at opposite ends thereof to enable said screw insertion tool to pass through said cutouts and into said recessed bore.

10. The superconducting magnet connector assembly of claim 9 wherein said securing means are positioned at opposite ends of said end plate intermediate said cutouts.

11. The superconducting magnet assembly of claim 10 wherein said polygon is a hexagon.

12. The superconducting magnet connector assembly of claim 6 wherein said retractor tool and said adapter connector include a mating ridge and keyway to assist in the proper connection of said retractor to said adapter connector.

13. The superconducting magnet connector assembly of claim 1 wherein said adapter connector includes a plurality of central apertures in place of connections in an industry standard connector configuration in order to allow cryogen gas to pass through said apertures to cool said adapter connector.

14. In a superconducting magnet assembly located in a pressurized chamber cryostat containing a liquid cryogen with an outer shell spaced from the pressurized chamber, and in which cryogen boil-off is vented out of the pressurized chamber, at least one connector assembly to connect electrical power from outside said shell to magnet coils positioned within said chamber comprising:

a first electrically conductive connector secured to and extending through said pressurized chamber;

a power lead assembly extending from outside said shell and including a mating second connector for electrical connection to said first connector;

at least one passageway extending axially through the central region of said first connector to conduct the flow of cryogen gas from inside said pressure vessel to the outside thereof;

whereby said first connector is cooled to reduce the heating otherwise generated by current flow therethrough;

said first connector includes a main coil lead pin assembly;

said pin assembly is fastened to a conductor bar interposed between said pin and said main coil;

said pin includes an extension projecting outside said pressurized vessel;

said extension is generally cylindrical in shape; and detachable power means to connect said second connector to said cylindrical extension to detachably connect power from outside said shell to the main coil of said superconducting magnet;

said power lead assembly including a generally cylindrical bore at the end remote from said shell configured to surround said pin in good electrical contact with said pin;

a circumferential chamber formed within said bore; and a serrated sleeve including multiple offset connected surfaces about the circumference of said sleeve which extend between and contact the exterior surface of said extension and the interior of said bore.

15. The main coil lead pin assembly for a superconducting magnet of claim 14 wherein said sleeve is resilient and the exterior surfaces of said extension, said bore and said sleeve are silver-plated.

16. In a superconducting magnet assembly located in a pressurized chamber cryostat containing a liquid cryogen with an outer shell spaced from the pressurized chamber, and in which cryogen boil-off is vented out of the pressurized chamber, at least one connector assembly to connect electrical power from outside said shell to magnet coils positioned within said chamber comprising:

a first electrically conductive connector secured to and extending through said pressurized chamber; and a power lead assembly extending from outside said shell and including a mating second connector for electrical connection to said first connector;

at least one passageway extending axially through the central region of said first connector to conduct the flow of cryogen gas from inside said pressure vessel to the outside thereof;

whereby said first connector is cooled to reduce the heating otherwise generated by current flow therethrough;

said first connector includes a main coil lead pin assembly;

said pin assembly is fastened to a conductor bar interposed between said pin and said main coil;

said pin includes an extension projecting outside said pressurized vessel;

said extension is generally cylindrical in shape; and detachable power means to connect said second connector to said cylindrical extension to detachably connect power from outside said shell to the main coil of said superconducting magnet;

said power lead assembly including a generally cylindrical bore at the end remote from said shell configured to surround said pin is good electrical contact with said pin;

said sleeve comprises a series of louvers extending axially at an angle to said circumferential chamber and connected at the top and bottom thereof by circumferential bands.

17. The main coil lead assembly for a superconducting magnet of claim 16 wherein said sleeve includes a series of teeth extending axially from said circumferential bands.

18. The main coil lead assembly for a superconducting magnet of claim 17 wherein said angle is in the order of 15 degrees.

* * * * *